United States Patent [19]

Yamaguchi et al.

[11] 4,324,342

[45] Apr. 13, 1982

[54] EASILY OPENABLE COVER MEMBER

[75] Inventors: Kisaburo Yamaguchi, Hachioji; Tsukasa Yoshikawa, Yamato, both of Japan

[73] Assignee: Tokan Kogyo Kabushiki Kaisha, Japan

[21] Appl. No.: 160,591

[22] Filed: Jun. 18, 1980

Related U.S. Application Data

[62] Division of Ser. No. 55,909, Jul. 9, 1979, Pat. No. 4,256,239.

[30] Foreign Application Priority Data

| | | | |
|---|---|---|---|
| Jul. 26, 1978 | [JP] | Japan | 53-101939 |
| Oct. 19, 1978 | [JP] | Japan | 53-142787 |
| Oct. 23, 1978 | [JP] | Japan | 53-145655 |

[51] Int. Cl.[3] ..... B65D 17/32

[52] U.S. Cl. ..... 220/268; 220/270

[58] Field of Search ..... 220/265, 270; 222/541; 215/250, 253, 254

[56] References Cited

U.S. PATENT DOCUMENTS

| | | | |
|---|---|---|---|
| 4,081,103 | 3/1978 | Zoellick | 220/268 X |
| 4,210,256 | 7/1980 | Amberg et al. | 220/268 X |

*Primary Examiner*—George T. Hall

*Attorney, Agent, or Firm*—Thomas J. Greer, Jr.

[57] ABSTRACT

An easily openable cover member for a container which is formed from thermoplastic synthetic resin of high flexibility and which integrally has unsealing means for opening an openable portion defined by a thinned portion and said unsealing means is integral with and extends upwardly of the openable portion. The cover member has been formed by injection-molding synthetic resin so as to have the openable portion integrally formed with the unsealing means.

4 Claims, 20 Drawing Figures

EASILY OPENABLE COVER MEMBER

This is a division of application Ser. No. 55,909 filed July 9, 1979, now U.S. Pat. No. 4,256,239.

DESCRIPTION OF PRIOR ART

A variety of metal covers for sealing containers which can be easily opened without the use of any separate opening means have been proposed.

Any of the prior art for making easily openable metal covers for containing requires a substantial number of steps and a great deal of cost for providing unsealing means to the cover. In order to eliminate the disadvantages inherent in the prior art metal covers for containers as referred to hereinabove, it has been proposed to produce an easily openable synthetic resin cover for a container which has unsealing means integrally formed therewith. However, the synthetic resin cover has the disadvantage that the unsealing means is vulnerable to damage when the cover is opened. The synthetic resin cover also has the disadvantage that a satisfactory undercut portion can not be designed when the cover is molded.

That is, as shown in FIG. 1, in most cases, an upwardly extending three-dimensional unsealing means is integrally formed on the cover sheet 14 of the cover member 12 so that the openable portion 20 defined by the thinned portion 16 on the cover sheet 14 of the cover member 12 can be easily removed from the cover sheet 14. When the unsealing means 30 is pulled up by the user's fingers, the leg 32 of the unsealing means 30 frequently breaks at the base 31. And when the cover member is removed from the injection molding die set after the cover member has been injection-molded in the molding cavity 58 in the injection molding die set 50 as shown in FIG. 2, if a knock-out force is delivered to the produced cover member after the withdraw of the sliding core 52, the leg 32 of the unsealing means 30 is frequently damaged by the projection 56 of the core 54.

SUMMARY OF THE INVENTION

Therefore, one object of the present invention is to provide an easily openable cover member for a container having three-dimensional unsealing means which is not vulnerable to damage.

Another object of the present invention is to provide a cover member for a container which has three-dimensional unsealing means integrally formed therewith and which can be easily formed by injection molding.

Another object of the present invention is to provide an easily openable cover member for a container which is relatively less expensive and which has increased rigidity with the addition of an auxiliary cover disc thereto.

The above and other objects and attendant advantages of the present invention will be more readily apparent to those skilled in the art from a reading of the following detailed description in conjunction with the accompanying drawings which show preferred embodiments of the invention for illustration purpose only, but not for limiting the scope of the same in any way.

PREFERRED EMBODIMENT OF THE INVENTION

Figure 4:
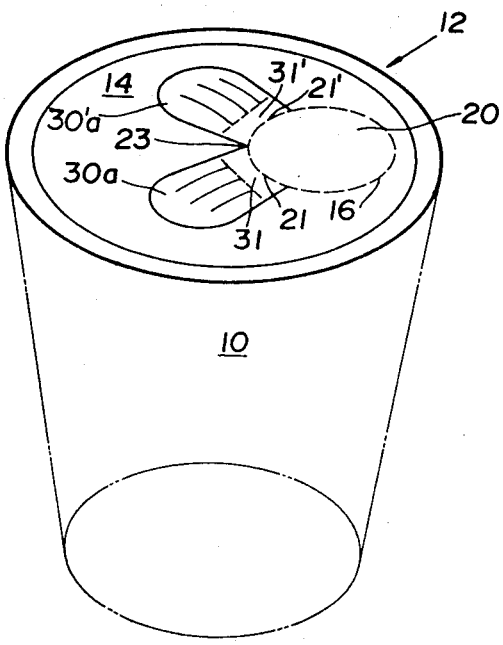
FIG. 4 is a perspective view of a container which is sealed by a first embodiment of cover member having a tongue-shaped unsealing means integrally formed therewith constructed in accordance with the present invention.

In the production of the cover member 12 as shown in FIG. 4 which is adapted to be fitted on, adhered to or tightened about the body of a container 10, the cover member 12 is formed from synthetic resin of high flexibility so as to have an openable portion 20 defined by an oval thinned portion 16 on the undersurface of the cover sheet 14 of the cover member. The openable portion 20 has at one end a corner area 23 defined by the two opposite sides 21, 21' of the thinned portion 16. A pair of tongue-shaped unsealing means 30*a*, 30*a'* extend upwardly from the upper surface of the cover sheet 14 on the two sides 21, 21' defining the corner area 23 and integrally formed at the bases 31, 31' with the sides 21, 21', respectively.

Figure 6:
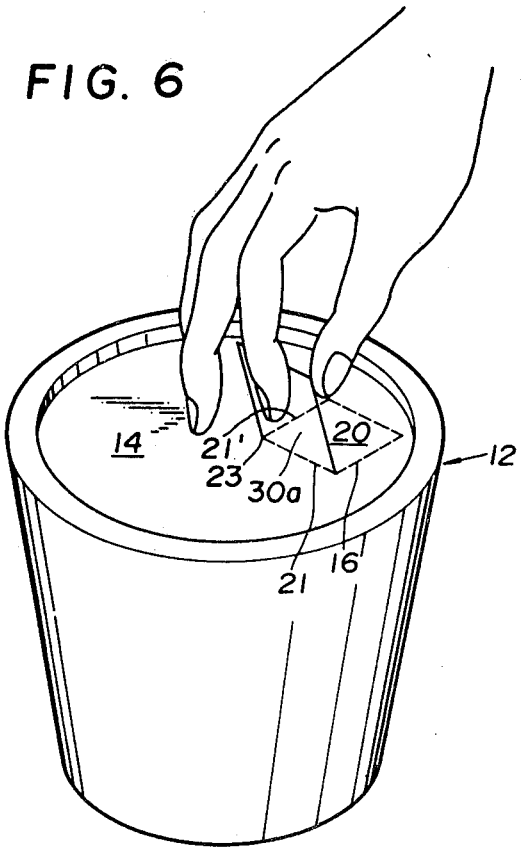
FIG. 6 shows the manner in which the openable portion of the cover member of the embodiment of FIG. 5 is removed by pulling the unsealing means up.

With the above-mentioned construction of the cover member 12 in FIG. 4, when the unsealing means 30*a*, 30*a'* are pulled up at the end remote from the bases 31, 31', as shown in FIG. 6, the pulling force is concentrated at the corner area 23 and an initial shearing occurs at the corner area whereby the openable portion 20 is then smoothly broken off along the thinned portion 16.

Figure 1:
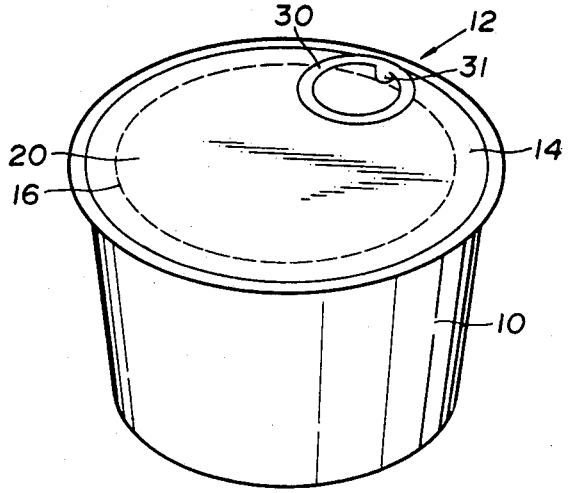
FIG. 1 is a perspective view of a container which is sealed by a prior art cover member having a pull ring type unsealing means integrally formed therewith.
Figure 2:
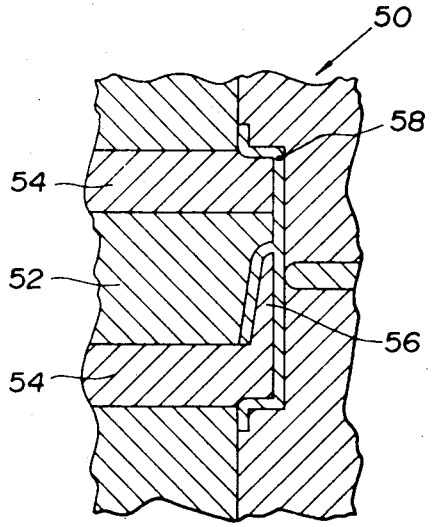
FIG. 2 is a fragmentary cross-sectional view of an injection molding die set for producing a cover member having an unsealing means integrally formed therewith.
Figure 3:
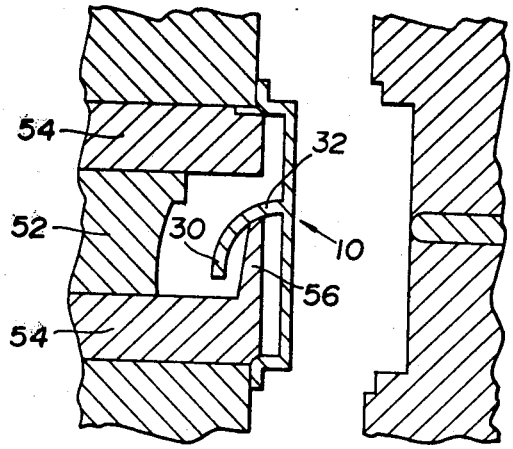
FIG. 3 is similar to FIG. 2, but shows the mating die parts in their separated position.

Although the unsealing means 30*a*, 30' are three-dimensionally formed, since the arrangement of the unsealing means is different from the arrangement of the annular unsealing means 30 which has a leg 32 projecting upwardly from the upper surface of the cover sheet, the unsealing means 30*a*, 30*a'* extend from the cover sheet 14 by a distance shorter than the distance of the annular unsealing means 30 from the upper surface of the cover sheet. Therefore, the molding die set 50 as shown in FIG. 2 can be reduced in size and since the cover member is formed from synthetic resin of high flexibility, after the molding of the cover member, when the produced cover member is separated from the molding die set, the cover member can be knocked out of the die set without inflicting any damage to the product which would otherwise occur in the production of the prior art cover member by the use of the molding die set as shown in FIG. 3.

Figure 5:
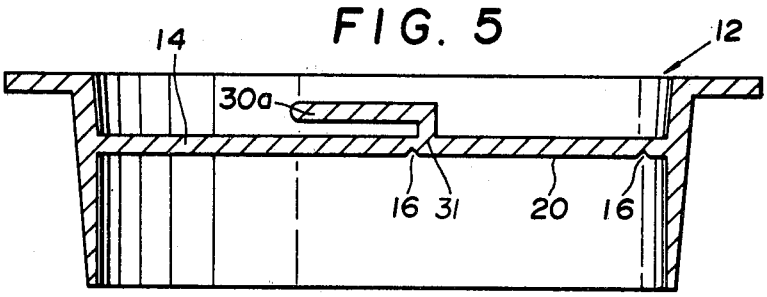
FIG. 5 is a vertically sectional view on an enlarged scale of said cover member as shown in FIG. 4.
Figure 7:
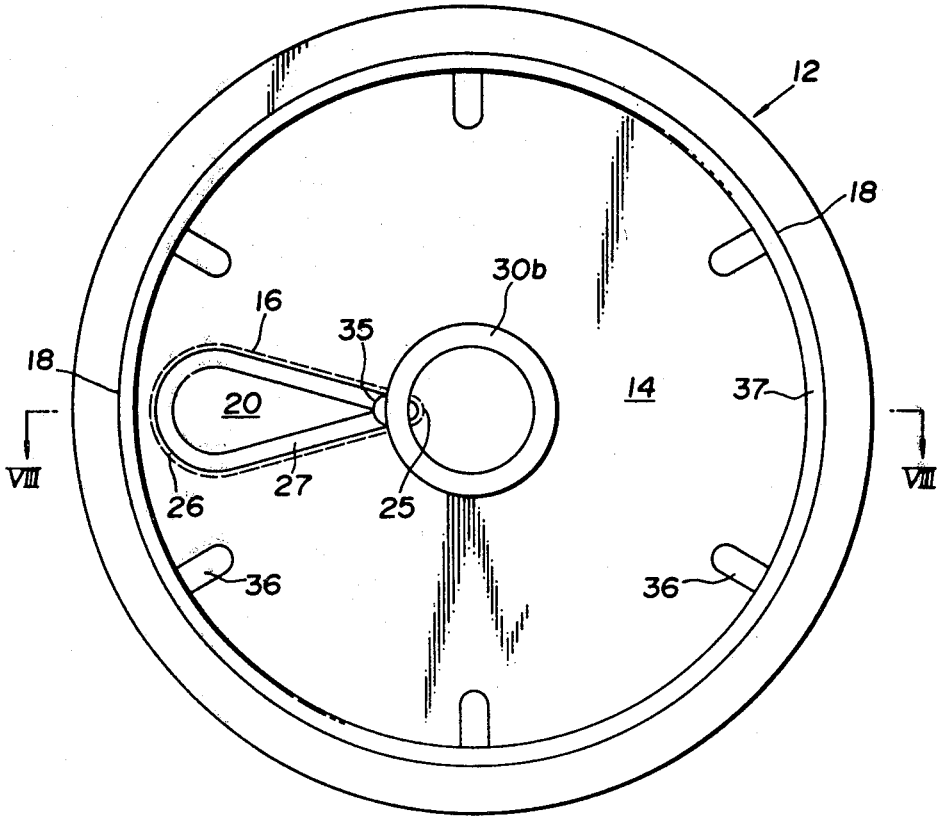
FIG. 7 is a plan view of a second embodiment of cover member having an annular unsealing means integrally formed therewith and an auxiliary cover disc fitted therein according to the present invention.
Figure 8:
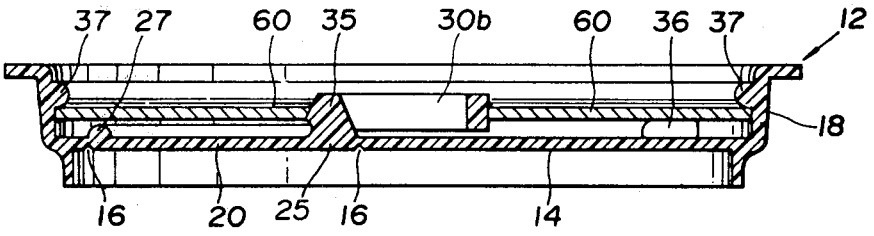
FIG. 8 is a vertically sectional view of said cover member as shown in FIG. 7.

FIGS. 7 and 8 shows a second embodiment of cover member 12 of the present invention. Although the first embodiment of FIGS. 4 and 5 has the advantage that the cover member can be easily formed without the possibility of breakage at the removable portion including the openable portion 20 and unsealing means 30*a*, 30*a'* because the cover member is formed from synthetic resin of high flexibility, the entire cover member is somewhat pliable due to the nature of the material. Therefore, the second embodiment of FIGS. 7 and 8 provides a reinforced construction so as to eliminate the disadvantage of the construction of the embodiment of FIGS. 4 and 5.

For the purpose, the cover member 12 of FIGS. 7 and 8 is integrally formed from a relatively flexible synthetic resin such as polyethylene or the like and in the embodiment, an annular unsealing tab 30*b* is formed substantially in the center of the cover sheet 14 on the upper surface thereof and connected to only one or the inner end 25 of a substantially triangular openable portion 20 by means of a connection 35 which extends upwardly from the upper surface of the cover sheet 14. Thus, the undersurface of the annular tab 30*b* is not directly connected to the cover sheet 14 except at the connection 35 (see FIG. 8).

The outer end 26 of the triangular openable portion 20 has a greater arc than the arc of the inner end 25. When the container sealed by the cover member is to be unsealed, a force applied to the annular tab 30*b* at the inner end 25 thereof is transmitted to the outer end 26 of the openable portion 20 through the connection 35.

A thinned portion 16 is formed along the entire outer side of the openable portion in a peripherally spaced relationship thereto and a thickened portion 27 is formed along the entire inner side of the thinned portion 16 so that the shearing of the openable portion 20 is accelerated. The thinned portion 16 is formed on the undersurface of the cover sheet 14 whereas the thickened portion 27 is formed on the upper surface of the cover sheet, respectively.

Figure 9:
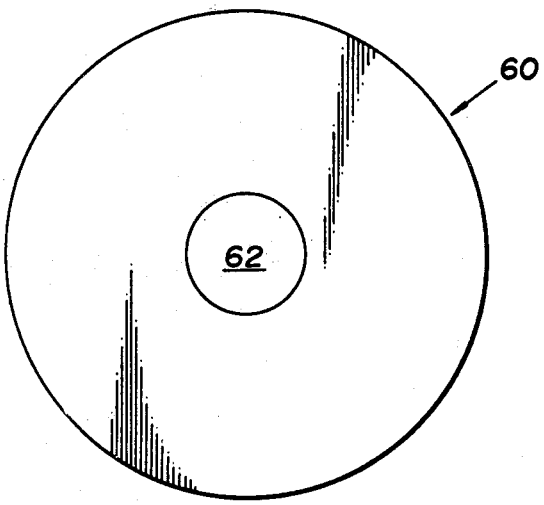
FIG. 9 is a plan view of said auxiliary cover disc inserted in the second embodiment of cover member as shown in FIGS. 7 and 8.

As more clearly shown in FIG. 7, a plurality of equally spaced auxiliary cover disc seats 36 are formed along the inner periphery 18 of the cover sheet 14 on the upper surface thereof and the seats extend radially and inwardly toward the center of the cover sheet. Also formed along the inner periphery 18 of the cover sheet 14 above the seats 36 is an annular engaging projection 37 which extends toward the center of the cover sheet by a radial distance smaller than the radial distance of the seats 36. The annular engaging projection 37 has a height greater than that of the seats 36 by the thickness of an auxiliary cover disc of which description will be made hereinafter. And as more clearly shown in FIG. 9, the auxiliary cover disc 60 is provided with a through hole 62 in the center thereof to give a doughnut configuration to the cover disc and has the outer diameter substantially corresponding to the inner periphery 18 of the cover sheet 14. The through hole 62 has the diameter substantially corresponding to the outer diameter of the annular tab 30*b* for the purpose to be described hereinbelow. The auxiliary cover disc 60 is formed from a stiff material such as a sheet of carboard or the like, for example. The auxiliary cover disc 60 is placed in position on the upper surface of the cover sheet by fitting the through hole 62 onto the tab 30*b* and inserting the outer periphery edge of the disc into between the seats 36 and engaging projection 37 as shown in FIG. 8. The center through hole 62 in the auxiliary cover disc 60 is also employed when the cover disc is removed from the cover sheet 14 for using the content of the container on which the cover member is employed.

As mentioned hereinabove, although the cover member 12 of the embodiment of FIG. 7 and 8 is formed from pliable synthetic resin, the annular tab 30*b* is positioned substantially in the center of the cover sheet 14 and connected to the openable portion 20 only at the connection 25 and the stiff cardboard auxiliary cover disc 60 is held in porition on the cover sheet 14 by means of the seats 36 and engaging projection 37, the cover member 12 has an increased shape holding ability.

Since the cover member 12 is formed from pliable synthetic resin material, even when the annular tab 30*b* is pulled up for unsealing the container, the connection 35 allows the tab 30*b* to be pliably pulled up and the pulling force applied to the tab can be transmitted to the openable portion 20 without deforming or damaging the cover member. After injection molding of the cover member 12 of FIGS. 7 and 8, the produced cover member 12 can be easily removed from the injection molding die set without being damaged because the material of the cover member is substantially pliable synthetic resin, the annular tab 30*b* positioned in the center of the cover sheet 14 is connected to the openable portion 20 of the cover sheet 14 at only the connection 25 so as to extent in parallel to the cover sheet 14 and deforms yieldingly whereby the efficiency of production of the cover member is improved.

And after the injection molding of the cover member in the injection molding die set, since a clearance corresponding to the thickness of the auxiliary cover disc 60 is maintained between the facing surfaces of the seats 36 and engaging projection 37 and the auxiliary cover disc 60 is snugly received in the clearance, the cover member 12 has a dual construction which provides a necessary shape holding ability to the cover member through the cover member proper has been formed from pliable synthetic resin as an integral product.

Figure 10:
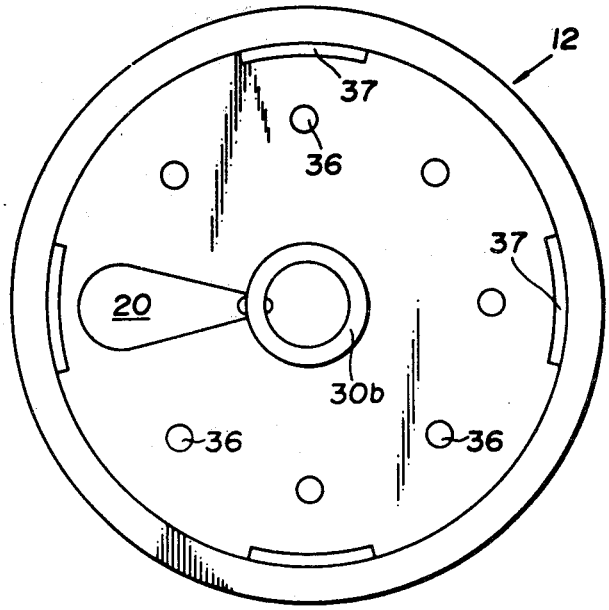
FIG. 10 is a plan view of a third embodiment of cover member of the present invention.

The auxiliary cover disc seats 36 are not necessarily provided along the inner periphery of the cover sheet 14, but instead may be provided in positions away from the inner periphery 18 of the cover sheet 14 on the upper surface of the latter in a circumferentially spaced relationship as shown in FIG. 10. And the engaging projection 37 is also not necessarily in the form of the continuous ring shape as shown in FIG. 7, but instead may be replaced by a plurality of circumferentially spaced engaging sectors 37 as shown in FIG. 10. It is only necessary that the facing surfaces of the seats 36 and engaging sectors 37 define a clearance therebetween sufficient to allow the user's finger to have access to the through hole 62 in the auxiliary cover disc 60 for removing the cover disc.

Figure 11:
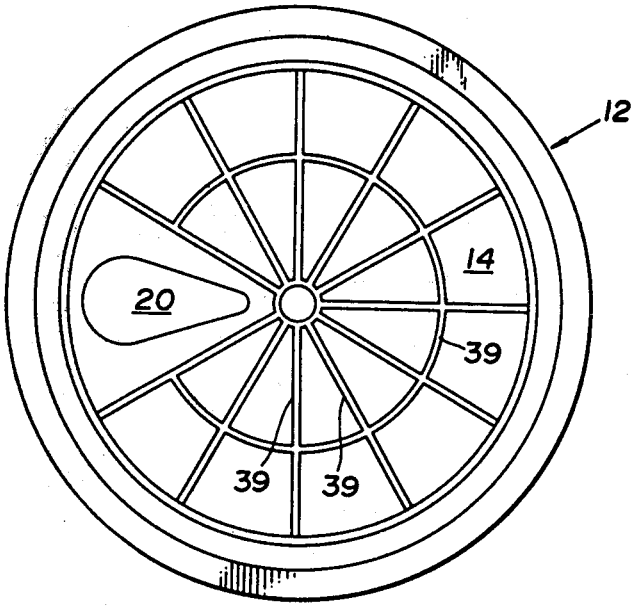
FIG. 11 is a reverse view of said cover member of FIG. 7.
Figure 12:
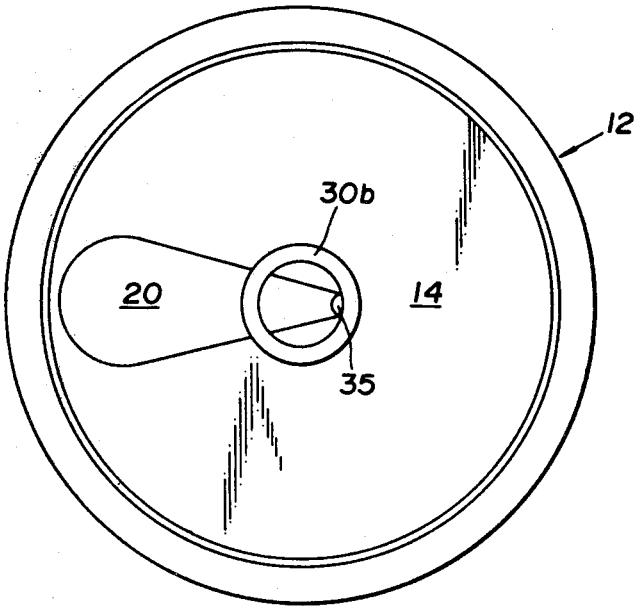
FIG. 12 is a plan view of a fourth embodiment of cover member of the present invention.

And as shown in FIG. 11, reinforcing means including a plurality of thickened ribs 39 which extend radially between the common center and the inner periphery and a plurality of thickened ribs 39 which connect the radial ribs at the outer ends and intermediate points can be also provided on the undersurface of the cover sheet 14 to increase the rigidity of the cover member 12.

If the diameter of the through hole 62 in the auxiliary cover disc 60 is slightly larger than the outer diameter of the annular tab **30*b* as shown in FIG. 7, when the container is desired to be unsealed, the auxiliary cover disc 60 can be removed by merely pulling the annular tab 30*b* up so as to shear the openable portion 20 off the cover sheet 14. However, according to the present invention, the diameter of the through hole 62 can be formed smaller than the outer diameter of the annular tab 30*b*. In such a case, the auxiliary cover disc 60 covers the annular tab 30*b* partially so that the tab 30*b* can be prevented from striking against any obstacle while the container having the cover attached thereto is being transported or stored to thereby eliminate the possibility of inadvertent shearing of the openable portion 20**.

Also in this case, the container can be easily unsealed by placing the user's finger into the through opening 62 to remove the auxiliary cover disc 60 and then pulling the annular tab **30*b*** up.

Although the openable portion 20 is shown as extending from a portion adjacent to the annular tab 30 toward the inner periphery 18 of the cover sheet 14 as shown in FIGS. 7 and 10, the inner or smaller arc end of the openable portion 20 may extend across the diameter of the opening of the annular tab **30*b* to increase the major diameter of the openable portion 20 whereby the area of the openable portion 20** is increased to the degree that the liquid contents of the container can be more easily and rapidly taken out of the container after the openable portion has been once removed.

In any of the embodiments as shown and described hereinabove, although the annular unsealing means or tab **30*b* and the through hole 62 in the auxiliary cover sheet 60 are coaxial to give a pleasant outer appearance to the cover member, the present invention is not limited to such arrangement of the annular unsealing means 30*b* and through hole 62**. An auxiliary cover disc having a through hole which is offset from the annular unsealing means may be also employed witout departing from the spirit of the invention.

In such a case, there is the advantage that the annular unsealing means or tab is prevented from being directly polluted by the user's finger which have access to the through hole in the unsealing means.

Figure 13:
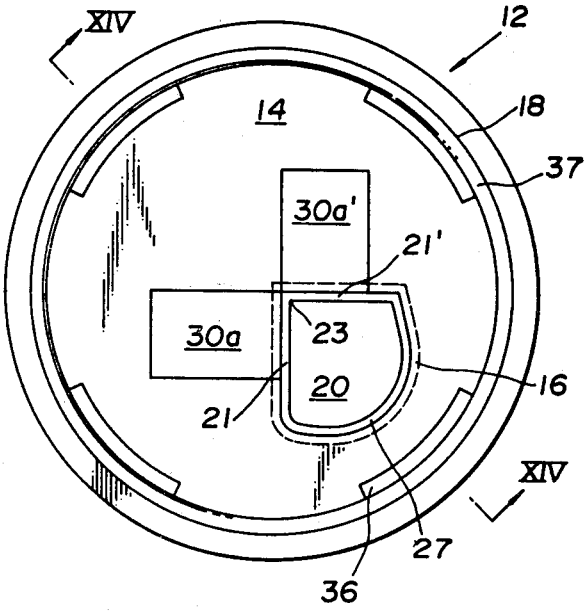
FIG. 13 is a plan view of a fifth embodiment of cover member having a tongue-shaped unsealing means integrally formed therewith of the present invention.
Figure 14:
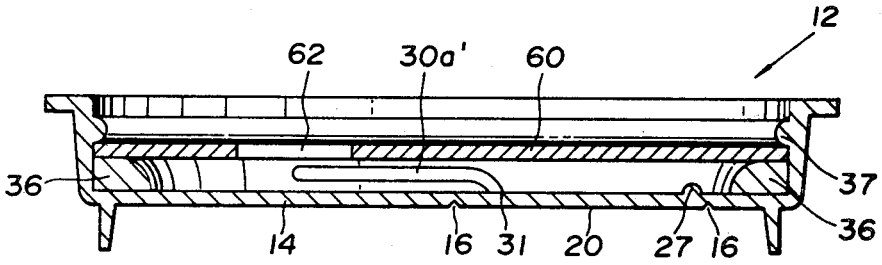
FIG. 14 is a vertically sectional view of cover member of the present invention which has an auxiliary cover disc fitted in the cover member of FIG. 13.

Another embodiment of cover member of the present invention is shown in FIGS. 13 and 14. In this embodiment, the bases of a pair of tongue-shaped unsealing means **30*a*, 30*b* on the upper surface of the cover sheet 14 are formed contiguous to the two opposing sides 21, 21' of the openable portion 20 the outer side of which is defined by the similarly shaped thinned portion 16 and the openable portion 20 is removed by pulling the unsealing means 20*a*, 30*b* up. In this embodiment, the auxiliary cover disc 60 is positioned above the upper bent portions of the unsealing means and held in positioned by the seats 36 and engaging projection 37 as shown in FIG. 14**.

In this embodiment, the through hole 62 in the auxiliary cover disc 60 is preferably provided above the cover sheet in a position offset from the openable portion 20. In this embodiment, when the user's finger is placed into the through hole 62 to remove the auxiliary cover disc 60, the area of the cover sheet 14 defining the openable portion 20 is protected against possible pollution after the removal of the cover disc and thus, the content of the container can be protected against possible pollution as the content is discharged out of the container.

Also in this embodiment, the openable portion is sheared off the cover sheet along the thinned portion 16 by pulling the unsealing tongues or means whereby the openable portion can be easily removed from the cover sheet.

Any of the embodiments as shown and described hereinabove has a circular configuration, but the present invention is also applicable to cover members having a triangular or other polygonal configurations.

Figure 15:
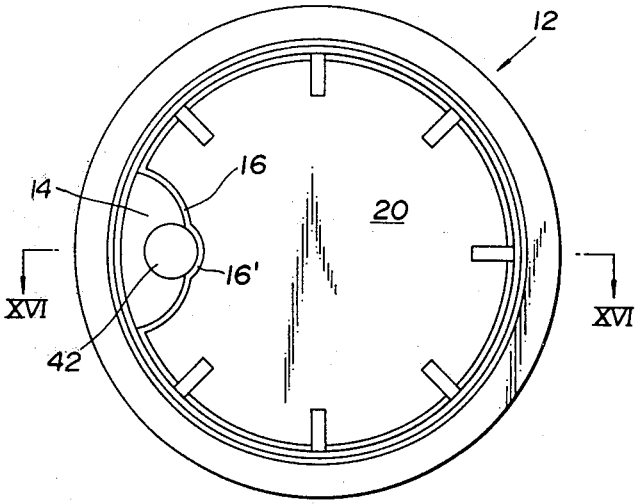
FIG. 15 is a plan view of a sixth embodiment of cover member of the present invention which uses a rigid depressing type unsealing means.
Figure 16:
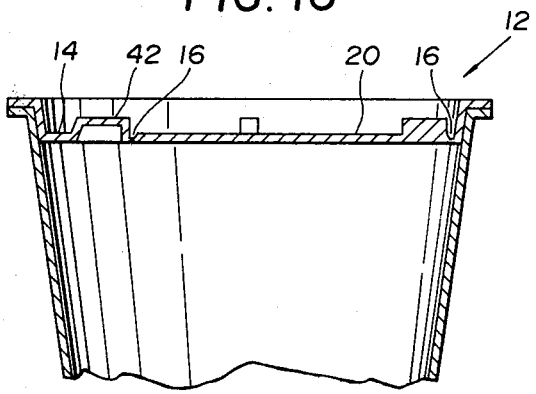
FIG. 16 is a vertically sectional view of said cover member of FIG. 15.

Another embodiment of cover member of the present invention is shown in FIGS. 15 and 16 and in this embodiment, the cover sheet 14 of the cover member 12 is formed with a substantially annular thinned portion 16 on the upper surface thereof along and inwardly spaced from the periphery of the cover sheet so as to define an openable portion 20 and a portion 16' of the thinned portion 16 curves inwardly toward the center of the cover sheet 14. An upwardly extending projection 42 is formed on the upper surface of the cover sheet 14 contiguous to the outer side of the inwardly curved thinned portion 16' so as to impart increased rigidity to the cover sheet, whereby even when any point of the projection 42 is applied a depressing force thereto, the entire projection 42 is subjected to the depressing force. In this embodiment, since the right-hand side of the projection 42 (as seen in FIGS. 15 and 16) is contiguous to the inwardly curved thinned portion 16', the depressing force is transmitted to the thinned portion 16' and an initial shearing occurs in the thinned portion 16'. Thus, even when a relatively light force such as a finger pressure is applied to the projection 42, the thinned portion 16' contiguous to the projection 42 can be easily shared.

Thereafter, when a spoon or like is forced through the sheared thinned portion 16' into the container and the spoon is then pushed against the inner surface of the openable portion 20 to lift the portion, the shearing force is translated to the rest of the thinned portion 16 to remove the entire openable portion 20.

When substantially the entire area of the cover sheet is surrounded by the peripheral rim except at the area of the projection 42 as shown in this embodiment, a substantially large openable portion 20 is formed so that the contents of the container can be easily and rapidly taken out of the container by the use of a spoon or the like after the openable portion 20 has been removed.

Figure 17:
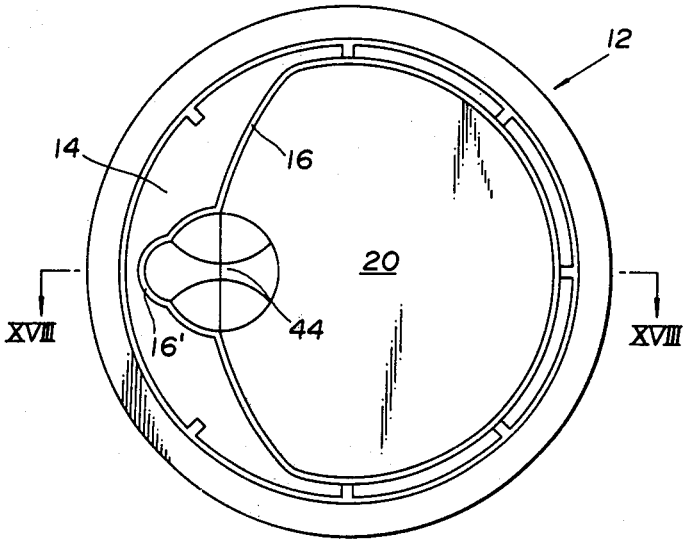
FIG. 17 is a plan view of a seventh embodiment of cover member of the present invention.
Figure 18:
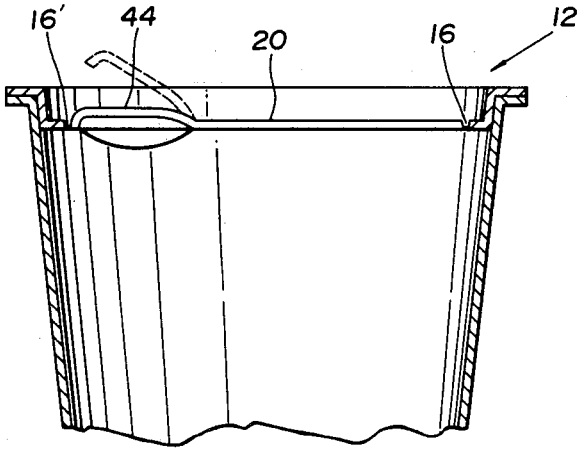
FIG. 18 is a vertically sectional view of said cover member of FIG. 17.

A still further embodiment of cover member of the present invention is shown in FIGS. 17 and 18 and in this embodiment, a suitable size openable portion 20 is defined by an annular thinned portion 16 provided on the cover sheet 14 on the upper surface thereof and the thinned portion 16 includes an outwardly bulging portion 16'. A thumb piece 44 is integrally formed on the upper surface of the cover sheet 14 intersecting the bulging portion 16' of the thinned portion 16 and extends above the cover sheet in a substantially parallel relationship thereto. With the above construction of the cover member of FIGS. 17 and 18, when the thumb piece 44 is gripped and pulled up, since the right-hand end of the thumb piece 44 is contiguous to the thick openable portion 20 whereas the left-hand end of the thumb piece is contiguous to the thinned or weakened bulging portion 16', the pulling force is concentrated at the left-hand end of the thumb piece to accelerate the initial shearing at the thinned bulding portion 16'. As the thumb piece 44 is further continued to be pulled up, the shearing force is translated all along the thinned portion 16 whereby the openable portion can be easily removed. As distinguished from the embodiment of FIGS. 15 and 16 in which after the initial shearing of the thinned portion, a spoon or the like is forced through the sheared portion into the container to pull the openable portion up, in the embodiment of FIGS. 17 and 18, after the initial shearing of the thinned portion by pulling the thumb piece 44 up, the openable portion can be easily removed by continuing the pulling of the thumb piece 44 without the aid of any separate opening means.

Figure 19:
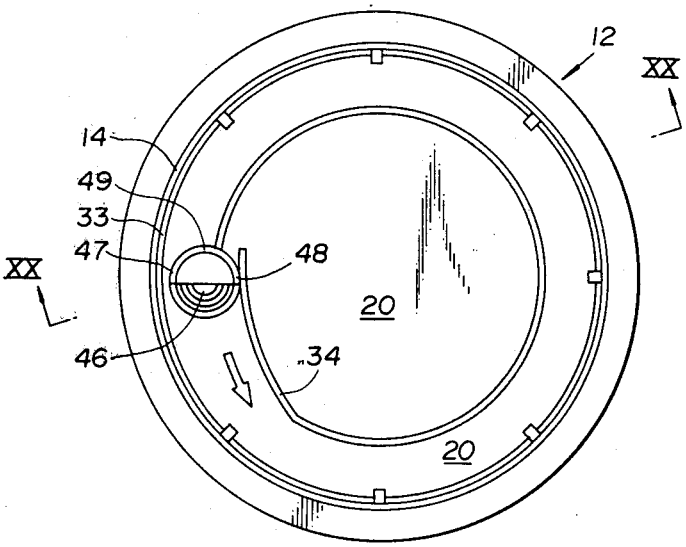
FIG. 19 is a plan view of an eighth embodiment of cover member of the present invention in which the openable portion formed along the periphery of the cover sheet of the cover member is removed by pulling the unsealing means up.
Figure 20:
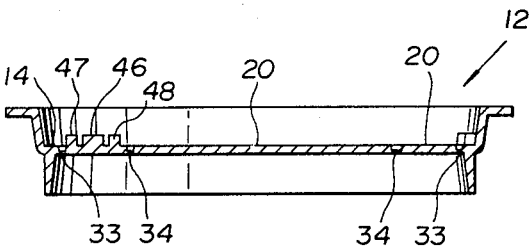
FIG. 20 is a vertically sectional view of said cover member of FIG. 19.

FIGS. 19 and 20 show a still further embodiment of the cover member of the invention and in this embodiment, the cover sheet 14 of the cover member 12 is formed on the upper surface with an openable portion 20 defined by an outer annular thinned portion 33, and an inner discontinuous annular thinned portion 34 a substantial portion of which is coaxial with the outer annular thinned portion 33 is formed on the openable portion 20 on the upper surface of the cover sheet. A rigid projection 46 extends upwardly from the upper surface of the cover sheet 14 adjacent the outer and inner annular thinned portions 33, 34 and includes a center projection portion 46 and a pair of opposite and spaced projecting sectors 47, 48 with a thinned portion 49 defined between the opposing ends of the sectors. With the above-mentioned arrangement of the embodiment of FIGS. 19 and 20, when the projection 46 is depressed down or pulled up, the thinned portion 49 is initially sheared off and the projection 46 is separated from the cover sheet 14 at the sheared thinned portion. Thereafter, as the projection 46 is further continued to be depressed down or pulled up, since the sectors 47, 48 of the projection 46 are contiguous to the outer and inner annular thinned portions 33, 34, the pulling up of the projection 46 shears the outer and inner annular thinned portions 33, 34 off the cover sheet 14 simultaneously.

Since the shearing progresses at the same time and in the same direction in the thinned portions 33, 34 ad the shearing progresses, the force required for pulling up the openable portion 20 and shearing the two thinned portions in this embodiment is substantially less than that required for pulling the corresponding part in the embodiment of FIGS. 15 through 18 in which the shearing progresses at the same time and in the left-ward and rightward or opposite directions in the tinned portion and thus, the unsealing operation in the embodiment is easier than in the preceding embodiments.

In the embodiment of FIGS. 19 and 20, although the inner annular thinned portion 34 is shown as being discontinuous, the present invention is not limited to such inner annular thinned portion and the inner annular thinned portion may be continuous.

While several embodiments of the invention have been shown and described in detail, it will be understood that the same are for illustration purpose only and not to be taken as a definition of the invention, reference being had for this purpose to the appended claims.

What is claimed is:

1. An easily openable integrally injection-molded cover member for a container which cover member includes a cover sheet formed from synthetic resin of high flexibility and having an integral openable portion defined by a thinned portion on said cover sheet and rigid unsealing means for removing the openable portion from the cover sheet, characterized in that said unsealing means does not provide a portion overlapping said cover sheet and characterized in that the total surface areas of the openable portion and the unsealing means are substantially equal to the surface area of said cover sheet.

2. The easily openable cover member for a container as set forth in claim 1, in which the rigid unsealing means is provided on said cover sheet outside of and contiguous to said thinned portion, whereby when said unsealing means is pushed down, said thinned portion is first sheared off at the inner portion of said unsealing means, then the openable portion is removed from the cover sheet.

3. The easily openable cover member for a container as set forth in claim 1, in which the rigid unsealing means is provided on said cover sheet inside of and contiguous to said thinned portion, whereby when said unsealing means is pulled up, said thinned portion is first sheared off at the outer portion of said unsealing means, then the openable portion is removed from the cover sheet.

4. The easily openable cover member for a container as set forth in claim 1, in which a second thinned portion is provided on said cover sheet inwardly of and spaced from first-mentioned thinned portion and has a portion in substantially coaxial relationship with the first-mentioned thinned portion, said rigid unsealing means being positioned between said thinned portions and contiguous to the thinned portions.

* * * * *